US006272311B1

(12) United States Patent
Baughman et al.

(10) Patent No.: US 6,272,311 B1
(45) Date of Patent: Aug. 7, 2001

(54) AIR COOLING STATION FOR ELECTROPHOTOGRAPHIC COPIER

(75) Inventors: Richard C. Baughman, Geneseo; Jeffrey H. Cokeley, Byron, both of NY (US)

(73) Assignee: Heidelberg Digital L.L.C., Rochester, NY (US)

( * ) Notice: Subject to any disclaimer, the term of this patent is extended or adjusted under 35 U.S.C. 154(b) by 0 days.

(21) Appl. No.: 09/689,147

(22) Filed: Oct. 12, 2000

(51) Int. Cl.[7] ..... G03G 15/20; H05B 1/00
(52) U.S. Cl. ..... 399/341; 219/216; 399/324
(58) Field of Search ..... 219/216; 399/68, 399/122, 323, 324, 328, 341, 405, 406; 430/126; 165/89, 90, 91, 92, 93

(56) References Cited

U.S. PATENT DOCUMENTS

| | | | | |
|---|---|---|---|---|
| 4,959,693 | * | 9/1990 | Mitsuya et al. | 399/341 |
| 5,235,393 | * | 8/1993 | Merle | 399/341 |
| 5,893,666 | * | 4/1999 | Aslam et al. | 399/341 |

* cited by examiner

*Primary Examiner*—Arthur T. Grimley
*Assistant Examiner*—Hoang Ngo
(74) *Attorney, Agent, or Firm*—Kevin L. Leffel

(57) ABSTRACT

The fusing assembly in an electrophotographic copier has a paper travel path passing between a pair of opposed air cooling plenums. Each plenum has an air supply plate confronting the travel path with slots for directing cooling air onto the moving paper. The lower plenum plate includes upstanding ribs parallel to the paper travel path for guiding the moving paper and spacing the paper from the plate to improve airflow by decreasing airflow impedance.

10 Claims, 1 Drawing Sheet

AIR COOLING STATION FOR ELECTROPHOTOGRAPHIC COPIER

TECHNICAL FIELD OF THE INVENTION

This invention relates to electrophotographic document copiers, and more particularly to an air cooling station having an improved air supply plate for directing air over the paper being transported away from the heated fuser rolls in such copiers.

BACKGROUND OF THE INVENTION

In electrophotographic document copiers, paper receiving the image to be copied is subjected to high temperature in the fusing assemblies which fix the copied image. It is essential that the paper be cooled in the equipment before the paper is ejected from the apparatus.

Typically in the prior art, the paper is transported away from the fusing rolls between a pair of opposed air plenums, through each of which cooling air is blown onto the paper. In such assemblies, the upper cooling plenum must be movable to permit access to the paper path for clearing paper jams. Each plenum is provided with spaced slots through which air is directed toward the paper passing through the cooling station.

This invention has an object to provide an improved air supply plate for the stationary lower plenum to guide the moving paper and to decrease airflow impedance and thus increase the air available to perform the cooling function.

SUMMARY OF THE INVENTION

In accordance with the present invention, there is provided a cooling station having an improved air supply plate for a plenum used to cool paper in an electrophotographic copier. The plate has upstanding ribs parallel to the paper travel path for guiding the paper and spacing it from the plate. Slots in the plate for directing air onto the paper are spaced across the travel path between the ribs.

In a preferred form of the invention, the ribs are arranged symmetrically about the centerline of the paper travel path, and opposed pairs of ribs are positioned to be slightly less than the width of typical paper sizes so that paper is supported and guided through the cooling station. A gap of about one-half inch between the opposed air plenum plates is provided in the preferred embodiment, and the ribs extend upwardly about one-quarter inch to space the paper from the plate and reduce airflow impedance. Airflow notches are formed in the trailing edge of the lower plenum plate to further reduce airflow impedance.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
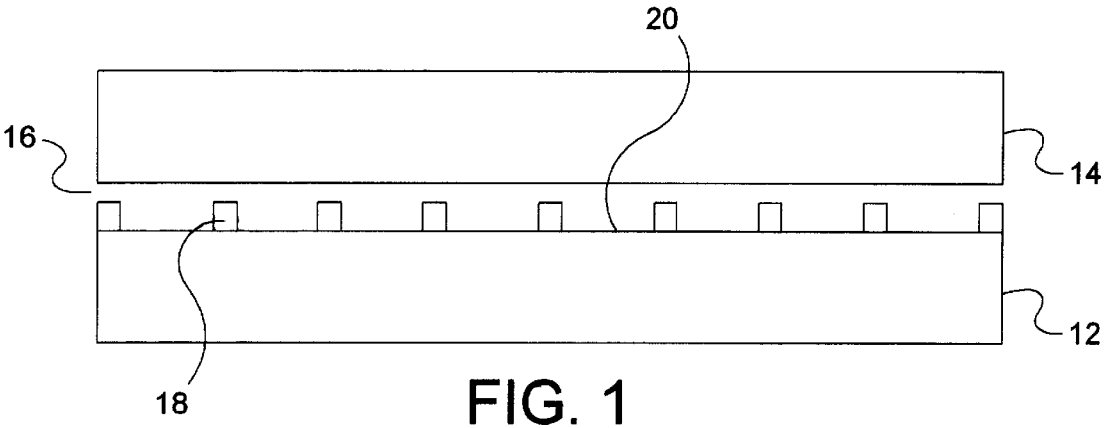
FIG. 1 is a schematic view of an electrophotographic copier air supply station constructed in accordance with the invention, taken from the paper exit.

An air cooling station constructed in accordance with the invention, as illustrated schematically in FIG. 1, includes a lower air plenum 12 and an opposed upper air plenum 14, separated by a gap 16. Copy paper passes from the copier fuser at an elevated temperature through the gap 16 between plenums 12 and 14.

A plurality of upstanding ribs 18 are formed on plate 18 of lower plenum 12. The ribs preferably extend about one quarter of an inch from plate, which is approximately one half of the width of gap 16. The ribs 18 may be symetrically arranged, and include pairs of ribs positioned to support typical paper sizes near their edges. Thus, pairs of ribs are located equidistant from the centerline at distances of just under eleven and fourteen inches apart.

Figure 2:
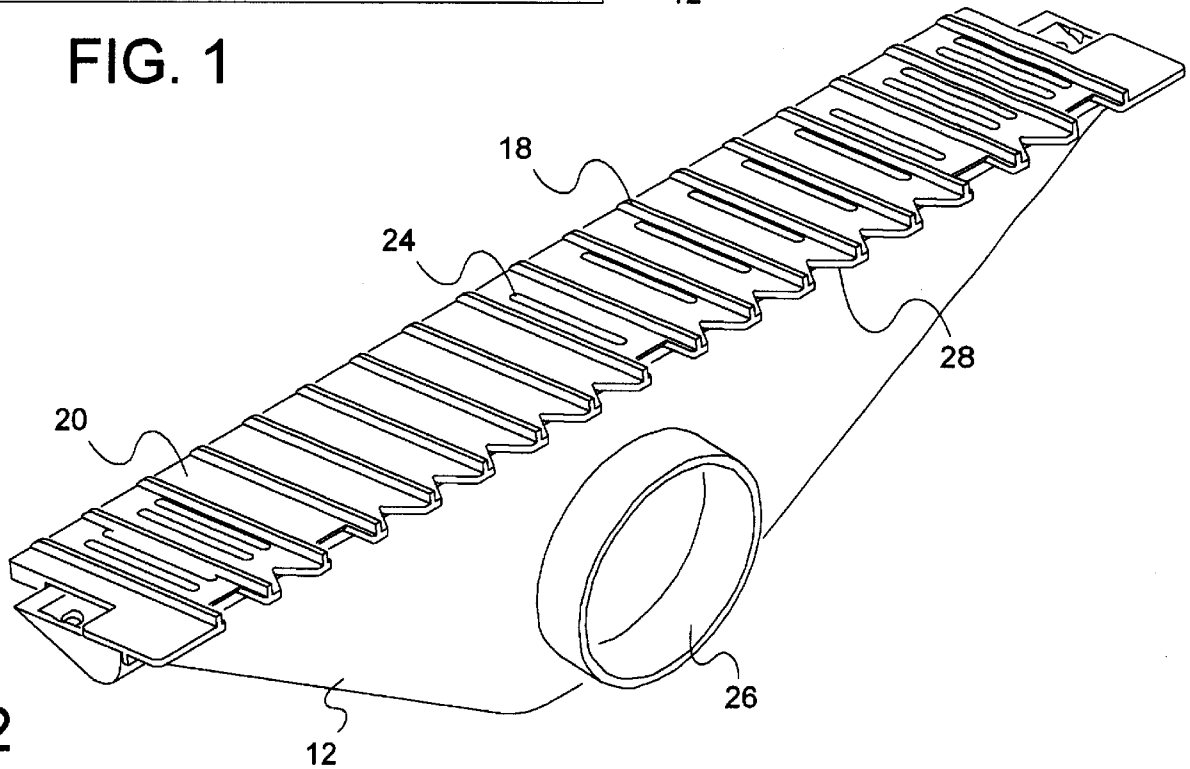
FIG. 2 is a perspective view of a lower air supply plenum constructed in accordance with the invention.

As seen in FIG. 2, a plurality of air supply slots 24 are located across the width of plate 20 between ribs 18. Air supplied to plenum 12 through duct 26 passes outwardly through slots 24 onto paper traveling in the gap 16. The copy paper is guided above plate 20 by ribs 18 so that space is provided for the movement of air outwardly from slots 24. Notches 28 are formed in the trailing edge of plate 20 between adjacent ribs to further aid in air movement.

This design reduces the airflow impedance from flat plate designs of the prior art, thus enhancing cooling airflow. Improvement in airflow on the order of fifty percent has been observed using this ribbed plate design.

Whereas the present invention has been described with respect to specific embodiments thereof, it will be understood that various changes and modifications will be suggested to one skilled in the art and it is intended to encompass such changes and modifications as fall within the scope of the appended claims.

What is claimed is:

1. In an electrophotographic copier employing a fuser assembly including an air-operated paper cooler having a pair of opposed air supply plates confronting the paper travel path, the improvement comprising:

(a) spaced upstanding ribs formed on at least one of said plates parallel to the paper travel path for guiding the paper and spacing the moving paper from said plate; and (b) air flow apertures formed in said plate between said ribs.

2. The improvement of claim 1, wherein each rib is upstanding from said plate approximately one-half the distance between the opposed plates.

3. The improvement of claim 2, wherein the distance between opposed plates is approximately one quarter of an inch.

4. The improvement of claim 1, wherein said upstanding ribs are symmetrically arrayed on the plate around the centerline of the paper travel path, and a first pair of said slots is spaced slightly less than fourteen inches apart, equidistant from the centerline of the paper travel path.

5. The improvement of claim 4, wherein a second pair of said slots is spaced slightly less than eleven inches apart, equidistant from the centerline of the paper travel path.

6. The improvement of claim 1, further comprising airflow notches formed in the trailing edge of the plate.

7. The improvement of claim 1, wherein the ribs are formed on the lower air supply plate.

8. An air supply station for cooling copy paper in the fuser assembly of an electrophotographic copier comprising:

(a) an upper air supply plenum positioned above the path of travel of the paper from the fuser rolls; and (b) a lower air supply plenum positioned below the path of travel of the paper from the fuser rolls having a plate confronting the paper travel path with upstanding ribs spaced across its width to guide the paper and space it from the plate surface, and having air slots positioned between the ribs.

9. The air supply station of claim 8, further comprising notches formed in the trailing edge of said plate between adjacent ribs.

10. The air supply station of claim 8, wherein the ribs extend about one-quarter inch above the surface of said plate.

* * * * *